US009745108B2

(12) United States Patent
Frolin

(10) Patent No.: US 9,745,108 B2
(45) Date of Patent: Aug. 29, 2017

(54) CONTAINER, IN PARTICULAR FOR FOOD USE

(71) Applicant: NEOLID, Lyons (FR)

(72) Inventor: Nicolas Frolin, Lyons (FR)

(73) Assignee: NEOLID, Lyons (FR)

( * ) Notice: Subject to any disclaimer, the term of this patent is extended or adjusted under 35 U.S.C. 154(b) by 44 days.

(21) Appl. No.: 14/782,648

(22) PCT Filed: Apr. 10, 2014

(86) PCT No.: PCT/IB2014/060620

§ 371 (c)(1),
(2) Date: Oct. 6, 2015

(87) PCT Pub. No.: WO2014/170805

PCT Pub. Date: Oct. 23, 2014

(65) Prior Publication Data

US 2016/0090219 A1 Mar. 31, 2016

(30) Foreign Application Priority Data

Apr. 16, 2013 (FR) ..... 13 53419

(51) Int. Cl.
*B65D 43/14* (2006.01)
*B65D 43/18* (2006.01)
(Continued)

(52) U.S. Cl.
CPC ..... *B65D 43/18* (2013.01); *B65D 25/14* (2013.01); *B65D 43/14* (2013.01); *B65D 51/00* (2013.01)

(58) Field of Classification Search
CPC ..... B65D 43/18; B65D 25/14; B65D 43/14; B65D 51/00; B65D 51/04; B65D 51/06; B65D 51/12
See application file for complete search history.

(56) References Cited

U.S. PATENT DOCUMENTS 4,917,247 A * 4/1990 Jud ..... B65D 75/5833 229/87.05
5,165,593 A * 11/1992 Chuang ..... B65D 5/0218 229/129
(Continued)

FOREIGN PATENT DOCUMENTS

EP 2050679 4/2009

*Primary Examiner* — Stephen Castellano
(74) *Attorney, Agent, or Firm* — Defillo & Associates, Inc.; Evelyn A Defillo

(57) ABSTRACT

The container (1) includes a body (2), a kinkable/unkinkable flexible sleeve (3) and an apertured maneuvering member (4) for maneuvering the sleeve (3). According to the invention: the body (2) and the member (4) have a globally square or rectangular shape in cross-section, giving the container (1) the appearance of a box; the member (4) is axially movable relative to the body (2), between a position in which it is freed from the wall of the body (2) and can therefore be pivoted relative to the latter, and a position in which it is engaged with the body (2); and the wall of the body (2) outwardly includes at least one part (5) made from a material having a high friction coefficient, and/or the apertured maneuvering member (4) includes, on its inner face, at least one part made from a material having a high friction coefficient.

6 Claims, 3 Drawing Sheets

(51) Int. Cl.
*B65D 51/00* (2006.01)
*B65D 25/14* (2006.01)

(56) References Cited

U.S. PATENT DOCUMENTS

2003/0124316 A1* 7/2003 Huang ..... B32B 29/08
428/182
2005/0082248 A1 4/2005 Al-Jadda

* cited by examiner

CONTAINER, IN PARTICULAR FOR FOOD USE

CROSS REFERENCE TO RELATED APPLICATION

This application is a national stage entry of PCT/IB2014/060620 filed Apr. 10, 2014, under the International Convention claiming priority over French Patent Application No. 1353419 filed Apr. 16, 2013.

FIELD OF THE INVENTION

The present invention relates to a container, in particular for food use.

BACKGROUND OF THE INVENTION

It is known to produce a container comprising a container body, a maneuvering ring and a flexible sleeve for closing/opening up the opening of the container body, that sleeve being connected to the container body, on the one hand, and to the maneuvering ring, on the other hand. The maneuvering ring is able to be pivoted relative to the body so as to kink/unkink the sleeve, between a kinking state, in which that sleeve closes off the opening of the container body, and an unkinking state, in which it opens that opening.

Such containers have always been made with cylindrical shapes, circular cross-sections, and with the maneuvering ring assembled on the container body. Such a form is indeed easy for the user to manipulate, and the maneuvering ring, immobilized in a given angular position by means provided to that end, can be placed in a large number of angular positions relative to the container body and thus provide various degrees of partial opening of the container. Furthermore, this circular shape allows a uniform deformation of the sleeve on the perimeter of the container body and the ring, and therefore allows good monitoring of the movement of the ring relative to the container body.

The circular shape nevertheless has the drawback of limiting the possible contents of the container and not being very suitable for containing food products other than liquids or similar products. In particular, this form is hardly adapted to contain cooked dishes.

OBJECTS OF THE INVENTION

The present invention aims to resolve this drawback while providing a container that can be completely closed by kinking the sleeve.

The invention also aims to provide a container allowing wide access to the product contained in the container.

The invention also aims to provide a container maintaining the closing state reliably.

The invention also aims to provide a container able to be adapted quickly and easily to cooking, for example in a microwave oven.

SUMMARY OF THE INVENTION

The container in question comprises, in a known manner, a container body, a flexible sleeve for closing off/opening up the opening of the container body, and an aperture maneuvering member, said sleeve being connected to the container body on the one hand, and to the aperture maneuvering member on the other hand; that aperture member is able to pivot relative to the container body so as to kink/unkink the sleeve, between a kinking state, in which that sleeve closes off the opening of the container body, and an unkinking state, in which it opens up that opening.

According to the invention, the container body and the aperture maneuvering member have a globally square or rectangular shape in cross-section, giving the container the appearance of a box;

the aperture maneuvering member is axially displace relative to the container body, between a position in which it is freed from the wall of the container body delimiting the opening formed by the container body, and is therefore able to be pivoted relative to the latter, and a position in which it is engaged on that wall and is braced by it, thus no longer being able to pivot relative to the container body; and said wall outwardly includes at least one part made from a material having a high friction coefficient, and/or said aperture maneuvering member includes, on its inner face, at least one part made from a material having a high friction coefficient.

This part makes it possible to generate friction between the container body and said aperture maneuvering member so as to ensure the engagement of that member on that wall. The risk of untimely escape of the aperture maneuvering member relative to the container body is thus greatly reduced.

As a result, the container according to the invention thus maintains the closing state reliably, notwithstanding its square or rectangular shape, which generates a non-uniform deformation of the sleeve on the perimeter of the container body and maneuvering member.

It will be understood that "cross-section" refers to the shape of the container body and the aperture maneuvering member in a plane perpendicular to the axis along which the aperture member can pivot relative to the container body to kink or unkink the sleeve.

It will also be understood that "generally square or rectangular shape" means that it is possible, on said body and said maneuvering member, to distinguish sides and corners. This notion of general square or rectangular shape must, however, be interpreted very broadly, including sides that may not be straight, but in particular curved, and corners that may not necessarily be very sharp, but rounded.

It will further be understood that "axially mobile" refers to the fact that said maneuvering member can be moved freely relative to the container body, along the axis along which that aperture member is able to pivot relative to the container body to kink or unkink the sleeve.

Whether it involves the part(s) present on the container body or the part(s) present on the aperture maneuvering member, that or those part(s) are preferably each in the form of a coating fastened on said wall of the container body or on said aperture maneuvering member.

This coating is preferably overmolded on that wall or that aperture maneuvering member.

The material having a high friction coefficient can in particular be a polymer.

When both said wall of the container body and said aperture maneuvering member comprise a coating as cited above, the two respective coatings may comprise surfaces configured to interpenetrate one another. In particular, these coatings may each have alternating ribs and splines, and the ribs and splines of one coating are offset relative to the ribs and spines of the other coating, such that the respective ribs and splines of those coatings interpenetrate one another when said aperture maneuvering member is in the engaged position on the container body.

Preferably, said wall of the container body and/or said aperture maneuvering member form snapping means allowing reversible snapping of that aperture maneuvering member in the engaged position on that wall of the container body.

This snapping contributes to ensuring maintaining of the closed state notwithstanding the non-uniform deformation of the sleeve due to the shape of the container in cross-section.

According to another aspect of the invention, in the unkinked state of the sleeve, the aperture maneuvering member is positioned such that its diagonals are offset relative to the diagonals of the container body, so that the pivoting travel necessary to perform kinking of the sleeve is greater than 180° and less than 270°.

The inventor was able to determine that it was possible to apply the aforementioned closing principle to a generally square or rectangular container, on the condition, however, that an aperture maneuvering member is provided that is axially movable relative to the container body, therefore able to be engage/disengage relative to the latter, and a pivoting travel greater than 180° and less than 270°. Indeed, the passage from a circular shape to a square or rectangular shape certainly has the favorable result of allowing angular bracing of said aperture maneuvering member on the container body, but also has the unfavorable result of greatly decreasing the number of possible angular positions of that member on that body, 90° apart in the case of a square box and 180° in the case of a rectangular box. The inventor was then able to determine that, in most cases, the optimal pivoting travel was situated between 180° and 270°, i.e., that travel should be sufficient to allow proper closing of the container, but not excessive closing, in which case it would create a risk of tearing or damaging the sleeve. The inventor then also conceived of positioning the diagonals of the aperture maneuvering member, in the unkinked state of the sleeve, offset relative to the counterpart diagonals of the container body, so that the pivoting travel necessary to close the container by kinking of the sleeve is greater than 180° and less than 270°.

It will also be understood that the aforementioned reference to the diagonals of the aperture maneuvering member and the diagonals of the container body is used to cover the fact that the body and said member can be square or rectangular; regarding a rectangular body and member, it would be possible to refer simply to the length of the body and that member: the length of the member is offset relative to the length of the body, such that those lengths form an angle between them such that the aforementioned pivoting travel is made possible.

The container according to the invention can either be tightly closed, without risk of damaging the sleeve, when said aperture maneuvering member is pivoted in the direction causing it to travel over more than 180°, or left partially open, for example for cooking in a microwave oven, when said aperture maneuvering member is pivoted in the direction causing it to travel over less than 180°.

Preferably, the aforementioned offset of the diagonals of the aperture maneuvering member is such that each diagonal of the aperture maneuvering member forms an angle of approximately 20° with the corresponding diagonal of the container body.

The kinking/unkinking travel of the sleeve is thus approximately 200° in one pivoting direction and approximately 160° in the opposite pivoting direction.

Preferably, said side wall of the container body and the opening delimited by the aperture maneuvering member are mutually configured such that said side wall of the container body fits in the opening delimited by the aperture maneuvering member, that side wall having no asperity or other obstacle that may, while the sleeve is not kinked, prevent movement of that aperture maneuvering member along that side wall toward a position separated from the opening formed by the container body.

This movement of the aperture maneuvering member makes it possible to stretch the sleeve around the side wall of the container body and therefore to withdraw that sleeve so that it does not hinder the access to the product contained in the container.

Wide access to the product is thus made possible. Furthermore, several containers according to the invention are able, in this position of the aperture maneuvering member, to be stacked on one another.

BRIEF DESCRIPTION OF THE DRAWINGS

The invention will be well understood, and other features and advantages thereof will appear, in reference to the appended diagrammatic drawing, showing, as a non-limiting example, one possible embodiment of the container in question.

DESCRIPTION OF A BEST MODE OF EXECUTION OF THE INVENTION

Figure 1:
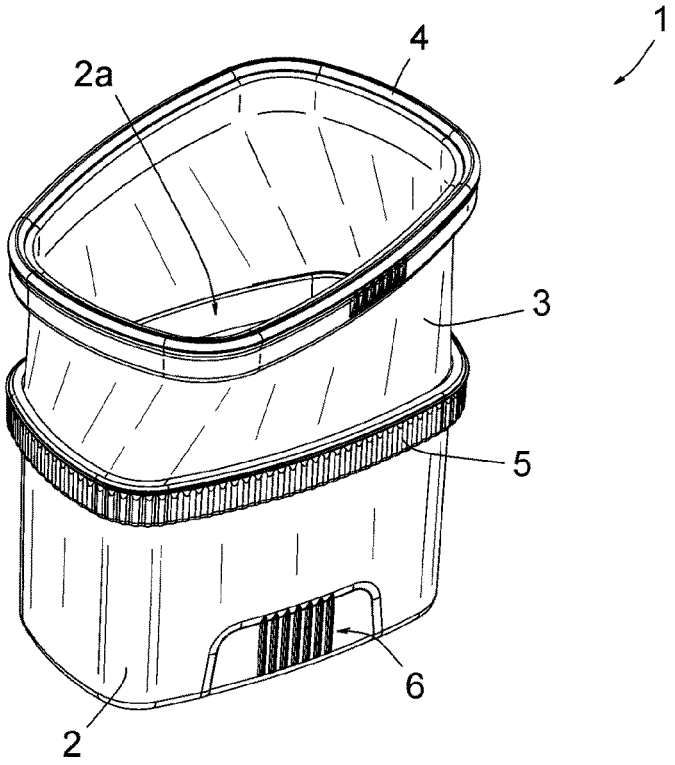
FIG. 1 is a perspective view, in a open position of the opening that it comprises, corresponding to an unkinked state of a flexible sleeve that it also comprises.

FIG. 1 shows a container 1 in particular for food use, comprising a container body 2, a kinkable/unkinkable flexible sleeve 3 for closing off/opening up an upper opening 2*a* formed by the container body 2, and an aperture member 4 for maneuvering the sleeve 3.

Figure 2:
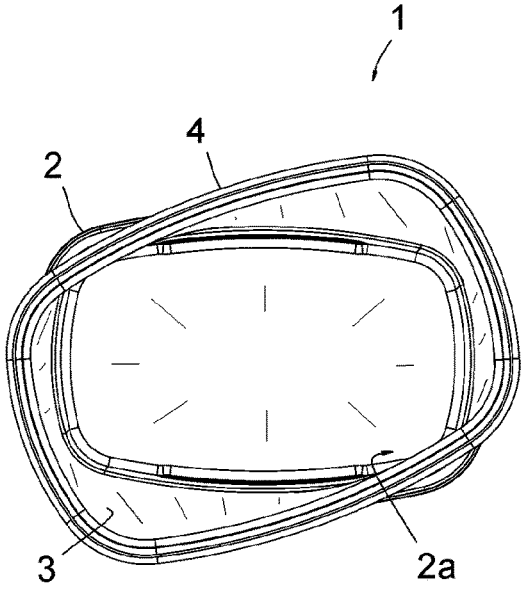
FIG. 2 is a top view, in the same opening state.

The container body 2 comprises a bottom and a peripheral wall delimiting the opening 2*a*, and has a general rectangular shape in cross-section, giving the container 1 a box-like appearance. This notion of general rectangular shape must be interpreted very broadly as being the fact that it is possible, on the body 2, to distinguish sides and corners; as shown in FIG. 2, the sides of the body 2 are not straight but curved, and the corners are not very sharp but rounded.

Figure 4:
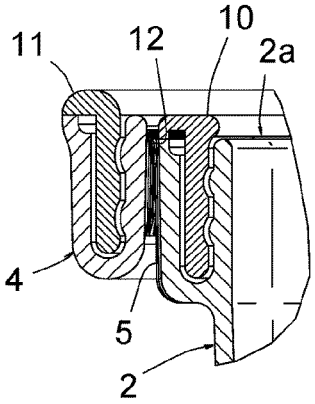
FIG. 4 is a sectional view along line IV-IV of FIG. 3.

As shown in FIGS. 1 and 4, the peripheral wall of the body 2 includes a peripheral coating 5 on its outer face, below its free edge delimiting the opening 2*a*. This coating 5 is a material having a high friction coefficient, such as a polymer, overmolded on the body 2. It has an irregular surface appearance, and in particular, as in the illustrated example, has alternating ribs and splines.

The two main side faces of the body 2 also comprise, overmolded thereon, gripping zones 6 on which ribs are also overmolded made from a material with a high fiction coefficient.

The sleeve 3 is made from a material with a high stretching coefficient, and particularly latex. It is closely connected to the free edge of the body 2, on the one hand, and the aperture maneuvering member 4, on the other hand, i.e., with a tight connection to the entire perimeter of that free edge and that member 4. As shown in FIG. 4, this tight connection is produced by arranging a peripheral slot in said free edge, forcibly receiving a peripheral ring 10 for capturing the corresponding edge of the sleeve 3 (the latter is not shown in this figure for clarity reasons), and by arranging a peripheral slot in the aperture member 4, forcibly receiving a peripheral ring 11 for capturing the corresponding edge of the sleeve 3.

This connection can also be done using another means, for example by overmolding the sleeve on the body 2 and the member 4.

Figure 3:
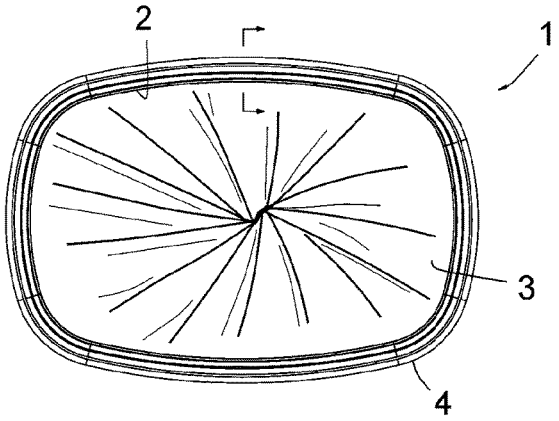
FIG. 3 is a top view, in the closed state of said sleeve by kinking, an aperture maneuvering member comprised by the container having been pivoted relative to the body of the container in the clockwise direction as shown in FIG. 2, i.e., over travel of 200° relative to the position shown in FIG. 2.
Figure 5:
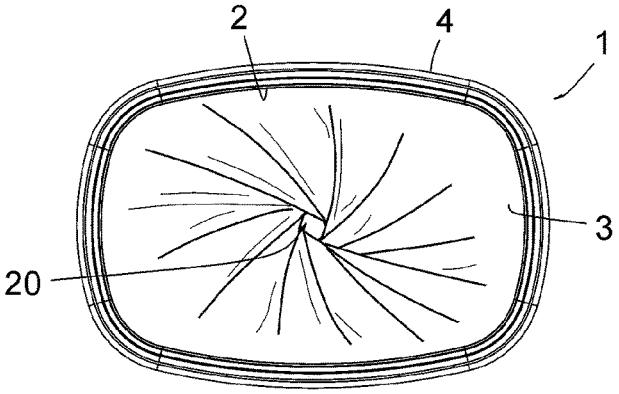
FIG. 5 is a view similar to FIG. 3, in a partial opening state, said aperture maneuvering member having been pivoted relative to the body of the container in the counter-clockwise direction as shown in FIG. 2, i.e., over a travel of 160° from the position shown in FIG. 2.

The aperture member 4 has a rectangular shape identical to that of the body 2, but is dimensioned so as to define a central opening such that it is able to be engaged in an adjusted manner and with friction around the opening edge of the body 2, see FIGS. 3 to 5. This member 4 is axially movable relative to the body 2 between the position shown in FIGS. 1 and 2, in which it is freed from the wall of the body 2 delimiting the opening 2*a* and is therefore able to be pivoted relative to the latter to kink/unkink the sleeve 3, and a position in which it is engaged on that wall and is braced by the latter, thus no longer being able to pivot relative to the body 2.

Figure 6:
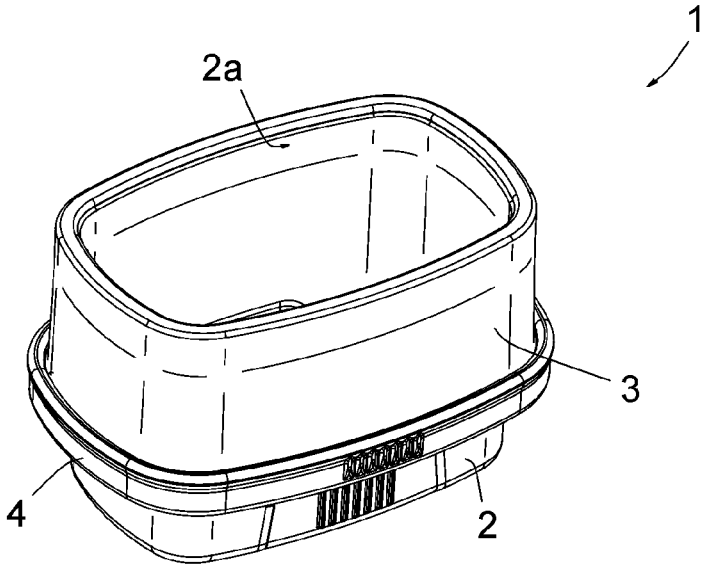
FIG. 6 is a view thereof similar to FIG. 1, in another position of said aperture maneuvering member relative to the container body.

As shown in FIG. 6, the side wall of the body 2 and the opening delimited by the member 4 are mutually configured such that that side wall fits into that opening, and that side wall has no asperities or other obstacles that may, when the sleeve 3 is not kinked, prevent the member 4 from moving along that wall toward a position separated from the opening 2*a* formed by the body 2.

The member 4 comprises a coating 12 overmolded on its inner face, also made from a material having a high friction coefficient, such as a polymer. This coating also has alternating ribs and splines, offset relative to the ribs and splines of the coating 5 such that the respective ribs and splines of those coatings 5 and 12 interpenetrate one another in the position of the member 4 engaged on the body 2.

In reference to FIGS. 1 and 2, it appears that in the unkinked state of the sleeve 3, the member 4 is positioned obliquely relative to the body 2, such that its diagonals are offset by 20° relative to the diagonals of the body.

From this position shown in FIG. 2, the member 4 is able to be pivoted clockwise, i.e., over a travel of 200° relative to that position, until it is engaged on the edge of the body 2. In an engaged position, shown in FIG. 3, the sleeve 3 is completely kinked and the container 1 is therefore tightly closed, without the kinking of the sleeve 3 being excessive, and therefore without risk of damaging that sleeve 3.

From this position shown in FIG. 2, the member 4 can be pivoted in the counterclockwise direction, i.e., over a travel of 160° relative to that position, until it is also engaged on the body 2. In the engaged position, shown in FIG. 5, the sleeve 3 is not completely kinked, which allows a central opening 20 to remain, for example allowing cooking in a microwave oven.

The movement of the aperture maneuvering member 4 and the position shown in FIG. 6 makes it possible to stretch the sleeve 3 around the side wall of the container body 2 and therefore to withdraw that sleeve so that it does not hinder access to the product contained in a container. Wide access to that product is thus made possible. Furthermore, several containers 1 are able, in that position of the member 4, to be stacked on one another.

It appears from the preceding that the invention provides a container 1 closed by sleeve kinking, having the decisive advantages of:

a. having a square or rectangular shape suitable for certain content such as cooked meals, while being suitable for being completely closed by kinking the sleeve 3;

b. maintaining the closed state reliably;

c. being able to form a central opening 20 suitable for cooking, for example a microwave oven.

The invention has been described above in reference to one embodiment provided as an example. It is of course not limited to this embodiment, but encompasses all embodiments covered by the appended claims. Thus, the aforementioned reference to the diagonals of the members 4 and the diagonals of the body 2 aims to cover the possibility of a body 2 and a member 4 with a square shape; for a body 2 and a member 4 that are more or less rectangular, as shown, reference may simply be made to the length of that body 2 and the length of that member 4: the length of the member 4 forms an angle of approximately 20° relative to the length of the body 2.

The invention claimed is:

1. A container comprising:

a container body including an opening and a wall delimiting the opening;

a sleeve made of a latex material, the sleeve closes or opens the opening of the container body; and an aperture maneuvering member;

said sleeve having a first side connected to the container body and a second side connected to the aperture maneuvering member;

the aperture maneuvering member axially moves relative to the container body to kink/unkink the sleeve between a kinking position, in which the sleeve closes off the opening of the container body, and an unkinking position, in which the sleeve opens up the opening;

wherein:

the container body and the aperture maneuvering member have a square or rectangular shape cross-section; and said wall and said aperture maneuvering are made from a polymer material;

wherein both said wall of the container body and said aperture maneuvering member comprise a coating and each coating comprises surfaces configured to interpenetrate with one another.

2. The container according to claim 1, wherein the surfaces on the coatings have alternating ribs and splines, wherein the ribs and splines of the coating of the wall of the container are offset relative to the ribs and spines of the coating of the aperture maneuvering member, such that the respective ribs and splines of those coatings interpenetrate one another when said aperture maneuvering member is in an engaged position on the container body.

3. The container according to claim 1, wherein in the unkinked position of the sleeve, diagonals of the aperture maneuvering member are positioned offset relative to diagonals of the container body, so that the pivoting travel necessary to perform kinking of the sleeve is greater than 180° and less than 270°.

4. The container according to claim 3, wherein the offset of the diagonals of the aperture maneuvering member is such that each diagonal of the aperture maneuvering member forms an angle of approximately 20° with the corresponding diagonal of the container body.

5. The container according to claim 1, wherein said wall of the container body and the opening delimited by the aperture maneuvering member are mutually configured such that said wall of the container body fits in the opening delimited by the aperture maneuvering member (4).

6. A container comprising:

a container body including an opening and a wall delimiting the opening, the wall includes a free edge and a peripheral slot on the free edge;

a sleeve made of a latex material, the sleeve closes or opens the opening of the container body; and an aperture maneuvering member including a peripheral slot;

said sleeve having a first side connected to the container body and a second side connected to the aperture maneuvering member;

the aperture maneuvering member axially moves relative to the container body to kink/unkink the sleeve between a kinking position, in which the sleeve closes off the opening of the container body, and an unkinking position, in the sleeve opens up the opening;

the peripheral slot on the free edge receives a first peripheral ring for connecting to the first side of the sleeve and the peripheral slot in the aperture maneuvering member receives a second peripheral ring to connect to the second side of the sleeve;

the container body and the aperture maneuvering member have a square or rectangular shape cross-section; and said wall and said aperture maneuvering member are made from a polymer material.

* * * * *